United States Patent [19]

Shishido et al.

[11] Patent Number: 4,856,781

[45] Date of Patent: Aug. 15, 1989

[54] GAME BALL

[75] Inventors: Hideomi Shishido; Shigeo Doi; Hideki Sumida; Masayuki Tanaka, all of Hiroshima, Japan

[73] Assignee: Molten Corporation, Hiroshima, Japan

[21] Appl. No.: 945,617

[22] Filed: Dec. 23, 1986

[30] Foreign Application Priority Data

| | | | |
|---|---|---|---|
| Jan. 16, 1986 | [JP] | Japan | 61-4964 |
| Mar. 31, 1986 | [JP] | Japan | 61-47207 |
| Apr. 8, 1986 | [JP] | Japan | 61-81438 |

[51] Int. Cl.[4] ..... A63B 41/00

[52] U.S. Cl. ..... 273/65 E; 273/65 EG

[58] Field of Search ..... 273/65 R, 65 E, 65 ED, 273/DIG. 020, 65 EB, 65 EC, 65 EG, 58 B, 58 BA

[56] References Cited

U.S. PATENT DOCUMENTS

| | | | |
|---|---|---|---|
| 1,718,305 | 6/1929 | Pierce | 273/65 E |
| 2,091,455 | 8/1937 | Riddell | 273/65 E |
| 2,244,503 | 6/1941 | Riddell | 273/65 E |
| 2,653,818 | 9/1953 | Tebbetts et al. | 273/65 E |
| 4,239,568 | 12/1980 | Takazawa | 273/58 BA |
| 4,333,648 | 6/1982 | Aoyama | 273/65 EB |

FOREIGN PATENT DOCUMENTS

| | | | |
|---|---|---|---|
| 31-8519 | 10/1956 | Japan | 273/65 ED |

*Primary Examiner*—George J. Marlo

*Attorney, Agent, or Firm*—Armstrong, Nikaido, Marmelstein, Kubovcik & Murray

[57] ABSTRACT

A ball for ball game comprises a rubber hollow spherical bladder, a valve holder fixed to the tube for charging air into the tube, a valve member attached to the valve holder; a fabric layer covering the bladder surface and a leather layer. The fabric layer is composed of a plurality of equilateral quadrilateral pieces sewn together to form a sphere. The equilateral quadrilateral pieces each include two sheets of approximately trapezodial fabric pieces that are sewed together symmetrically at a central seam line. The equilateral quadrilaterla pieces are sewed together such that central seam lines of adjacent equilateral quadrilateral pieces fall at right angles to ech other. The fabric layer gives sphericity, dimensional stability and durability to the ball. The leather layer is adhered to the fabric layer directly or through a rubber based thin intermediate layer. On a circumferential line in the fabric layer which includes one seam line, at least one other seam line exists at a prescribed interval to equally divide the un-sewn portions. All segments on the spherical surface of the fabric layer, which are divided by a plurality of circumferential lines including all of the seam lines, have the same shape.

10 Claims, 14 Drawing Sheets

GAME BALL

BACKGROUND OF THE INVENTION

The present invention relates to a ball used in ball games such as a volley ball and a soccer ball, and more particularly to a ball having a fabric layer as a reinforcing layer obtained by sewing together a plurality of pieces of woven fabric in a specific manner.

Hitherto, in the technical field of the above kinds of balls used in ball games, there is known a structure comprising a rubber hollow tube or bladder, a fabric layer, a rubber based thin layer and a leather outer casing (for example, U.S. Pat. Nos. 2,091,455 and 2,244,503) U.S. Pat. Nos. 2,091,455 and 2,244,503 disclose a ball structure comprising a rubber hollow bladder, a fabric layer surrounding the bladder, a rubber based thin intermediate layer coated on the fabric layer and a surface layer or outer casing. The fabric layer, used as a reinforcing layer, is formed by sewing together a plurality of shell-like fabric pieces. Further, it is known to form a fabric layer by overlapping and adhering a plurality of fabric pieces to each other (for example, U.S. Pat. Nos. 2,653,818 and 4,239,568. and Japanese Examined Patent Publication No. 8519/1956). U.S. Pat. No. 653,818 discloses a nonspherical athletic ball (ellipsoidal ball) such as a football, wherein the fabric pieces of the reinforcing layer are adhered to the bladder in a previously stretched state so as to minimize circumferential enlargement of the ball in a direction parallel to the minor axis. U.S. Pat. No. 239,568 and Japanese Examined Patent Publication No. 8519/1956 disclose a ball wherein a fabric layer is formed by adhering cloth strips in two layers on a spherical body in such a manner that edges of cloth strips overlap one another. The majority of current ball products, such as volley balls, use reinforcing layers comprising windings of thread formed by winding several thousands of meters of thread, such as nylon yarn, around a tube (for example, U.S Pat. No. 4,333,648 and Japanese Examined Patent Publication No. 3,934/1983). A reinforcing layer comprising wound yarn has a drawback because it gives a poor feel when the ball collides with the human body although such a ball having this type of reinforcing layer is superior with respect to several desirable characteristics namely, sphericity and durability. In U.S. Pat. No. 4,333,648 and corresponding Japanese Examined Patent Publication No. 319,34/1983, rubber threads are mixed into nylon threads to reduce this drawback.

Recently, with respect to ladies' volley balls, boys' soccer balls and the like, it has been strongly desired that such volley balls or soccer balls produce less pain upon collision of the balls with a body and have a soft "feel".

However, it is difficult to make the current balls feel soft using reinforcing layers comprising wound threads. As a result of vigorous investigation, we inventors discovered that balls having a softer feeling could be obtained by employing a structure wherein, instead of a reinforced layer comprising wound threads, a plurality of fabric pieces of woven fabric and the like are sewed together in a particular manner to form a sphere containing a bladder therein. Various kinds of concrete constructions thereof were examined.

Since fabric layers which ar sewed together not only feel soft but also provide dimensional stability, sphericity and durability, strict limitations are required for the quality of the material, shape, sewing structure of fabric pieces abutting each other, and the like.

Therefore, as in U.S. Pat. Nos. 2,091,455 and 2,244,503, using a structure comprising a rubber bladder, a fabric layer, a rubber based thin intermediate layer and a surface casing, it is almost impossible to maintain the sphericity of a ball because the sewed together portions are not equally distributed on the ball surface; the strength of the sewed together portions is different from that of other portions, i.e. it is generally larger than that of other portions; the direction of the warp and the direction of the weft of the fabric become uniform; and further stress is unevenly distributed due to the existence of two poles generated by the design of the fabric pieces. Moreover, the ball has a drawback because a soft feeling, which can be obtained in a bias direction of fabric texture, is lost since circumferential lines on the ball are solely composed of sewed together portions. Therefore, at present, no balls are manufactured having the above structure.

Also, balls having fabric layers obtained by pasting a plurality of fabric pieces to each other as in the above U.S. Pat. No. 4,239,568 and Japanese Examined Patent Publication No. 8519/1956 are inferior in mechanical strength, particularly in the tensile strength of the joined portions of the fabric pieces, because the fabric pieces are merely overlapped over one another. These balls also have problems in sphericity and durability. Further, the balls have a drawback because of a large change in their shape over time. Still further, in balls having the structure as described hereinbefore, the joined portions of the fabric pieces are thicker than the other portions of the fabric pieces, whereby unevenness in the outer surface of the ball occurs, i.e. so-called mirror through phenomenon, on the surface of the balls. This mirror through phenomenon causes passing errors when using, for example, volley balls, because the players hands are caught in the unevenness when the ball is passed. This unevenness can also cause pain when the ball hits the player's hands. The balls are inferior in merchandise value.

In order to avoid the above drawbacks, a method is used to equalize the thickness of the fabric layers by adhering additional pieces to the concave portions of the fabric layer where there is no seam overlap. As a result, a good feeling inherent in the fabric itself, is remarkably reduced due to the thick fabric layer and the interposition of adhesive. A ball having a structure wherein the fabric layer is composed of pasted fabric pieces, improves the feeling of the ball during a collision with the ball at the sacrifice of other characteristics of the ball such as sphericity and durability. A ball of the present invention not only gives a better feeling than these balls, but satisfies the other desirable characteristics such as sphericity, and durability.

In the balls of the above type composed of pasted fabric pieces, it is possible to pile up several more fabric layers described hereinbefore and to paste then one on another to reinforce the ball, in order to improve sphericity dimensional stability and durability. However, when the structure of the ball comprises piled up fabric layers, it is difficult to obtain balls having satisfactory properties such as sphericity, dimensional stability and durability.

The present invention was made to solve the above mentioned problems. An object of the present invention is to provide a ball having superior sphericity, dimensional stability and durability as well as having a soft feeling.

SUMMARY OF THE INVENTION

A ball of the present invention includes a fabric layer comprising a plurality of fabric pieces which are sewn to one another to form a sphere. The fabric layer satisfies the following conditions. That is, on a circumferential line in the fabric layer including any one sewn seam line, other sewn seam lines exist at prescribed intervals to equally divide the un-sewed portions of the fabric layer. Further, all segments on the spherical surface of the fabric layer, which are divided by a plurality of circumferential lines, including all seam lines, have the same shape.

An example of the fabric layer is obtainable by symmetrically sewing together a pair of approximately trapezoidal fabric pieces, each defined by two approximately parallel long sides and (wherein and satisfy the relationship of which are curved outwardly and two short sides having a length equal to each other (wherein and satisfy the relationship of $B=2C$), to form an equilateral quadrilateral piece, and then sewing together six such equilateral quadrilateral pieces in such a manner that the central sewn seam of each of the equilateral quadrilateral pieces abutting each other falls at right angles with the central sewn seam of the adjacent pieces to form a sphere.

On an imaginary circumferential line obtained by extending any one seam line around the fabric layer, one sewn seam and another sewn seam exist to equally divide the un-sewn portions. Therefore, even on the above circumferential line, the soft feeling of the fabric texture of the un-sewn portions is not reduced in a bias direction.

Also, a plurality of circumferential lines including all seam lines satisfy the above-mentioned condition. These circumferential lines ar equally distributed on the spherical surface. That is, all segments on the spherical surface divided by the circumferential lines have the same shape.

Since the seam lines do not form closed circumferential lines by themselves alone and are equally distributed on the spherical surface, a stretchability based on the fabric texture, namely a soft feeling, is exhibited to the maximum. Such functions are uniform throughout the ball surface.

BRIEF EXPLANATION OF THE DRAWINGS

FIG. 22(*b*) is a graph showing a relationship of a Fourier-transformed sensitive frequency ($\omega$) and a power spectrum (M) with respect to the waveforms shown in FIG. 22(*a*);

DETAILED DESCRIPTION

The following is a detailed description of embodiments of the present invention wherein the characteristics of the present invention are applied to a volleyball.

FIGS. 1 to 9 show a first embodiment of the present invention.

Figure 1:
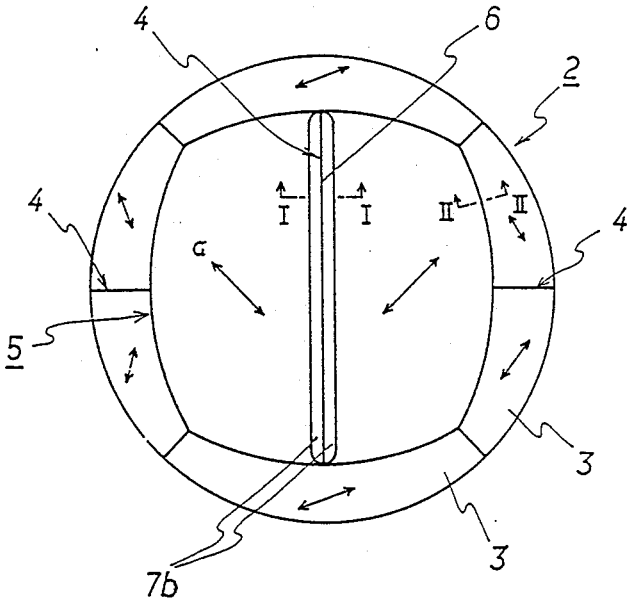
FIG. 1 is a front view of a first embodiment of a fabric layer in the present invention.
Figure 2:
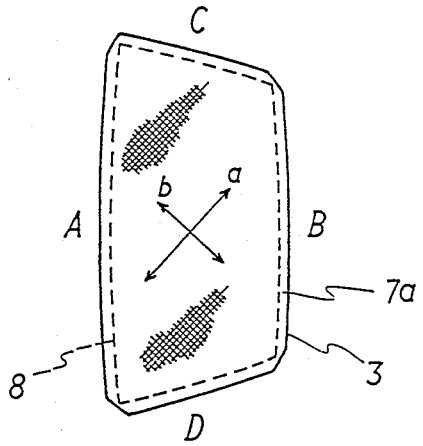
FIG. 2 is a front view of a fabric piece in the first embodiment.
Figure 3:
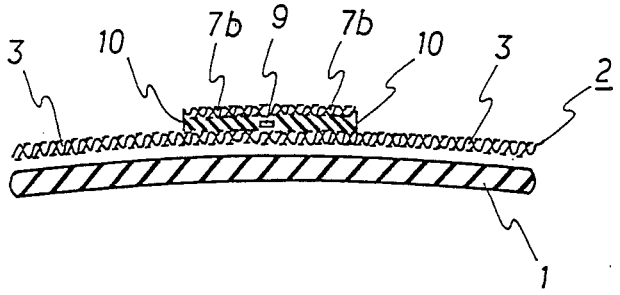
FIG. 3 is a sectional view showing a containing opening in the fabric layer in the first embodiment wherein a tensile force is not given to the fabric layer.

In FIGS. 1 to 3, numeral 1 is a bladder whereinto compressed air is charged. The bladder is a hollow sphere and made of rubber such as isobutylene-isoprene rubber having low air permeability. A valve used for injecting (charging) air into the bladder 1 is fixed to the bladder 1. Through the valve, air is injected to raise the internal pressure of the bladder 1 up to about 0.4 $kg/cm^2$ to about 0.5 $kg/cm^2$. Numeral 2 is a fabric layer covering the bladder 1 and serving as a reinforcing layer. The fabric layer is made by sewing together twelve approximately trapezoidal fabric pieces 3 to form a sphere. Each pair of fabric pieces are sewed to each other in such a manner that the longest sides thereof are sewn together so that an equilateral quadrilateral piece 5, symmetrical about the center seam line 4, is produced. Six sets of equilateral quadrilateral pieces 5 are produced in such a manner as described above. The pieces 5 are sewn together to form a sphere such that each center line 4, of the quadrilateral pieces 5 abutting one another, is at a right angle with respect to the center lines of the adjacent pieces. Numeral 6 is a containing opening, is made by leaving a part of the central seam line 4 of one of equilateral quadrilateral pieces 5 unsewed, and is for introducing the bladder into the fabric layer. The central seam line 4 of the particular equilateral quadrilateral piece 5 having the containing opening 6 is sewn at both of its end portions for several centimeters respectively. That is, the middle portion of the central seam line 4 is not sewn up. The reason why the containing opening 6 is formed at the central seam line 4 is that, if the opening 6 were formed, for example, at a side of one of the equilateral quadrilateral pieces 5, the seam margin *7a* would later emerge in the surface of the fabric at an intersection of that side and the central seam line 4 of an adjacent equilateral quadrilateral piece 5, thereby forming a projection due to the overlap of the seam margins *7a* and *7b* of adjacent pieces, causing a mirror through phenomenon or unevenness on the outer surface.

The shape of fabric pieces 3 is approximately trapezoidal and is defined by two approximately parallel long sides and (wherein and satisfy the relationship of which are curved outwardly and two short sides which are of equal length (wherein and satisfy the relationship of $B=2C$). The fabric pieces 3 are cut to a size that is a little larger than the size which ca cover the surface of the bladder 1, as shown in short dashed lines in FIG. 2. Accordingly, the fabric pieces 3 have seam margins of about ½ cm wide. The above short dashed line is a sewing line 8. Although the two long side and are not strictly parallel to each other, since they are curved in a reverse direction as shown in FIG. 2, they ar expressed to be approximately parallel in the present specification because two straight lines connecting each apex are parallel to each other. The fabric pieces 3 can perfectly cover the spherical surface of bladder 1 because of the curve of each side.

Two sheets of fabric pieces 3 are laminated together and are sewn up along a sewing line 8 by thread 9 using a machine to form a bag. In order to improve the strength of the sewn-together portions, each seam margin 7 may be folded back 180° and adhered to the inner surface of the fabric layer 2 using an adhesive (not shown). Also, the seam margins *7a* may be laminated and folded back in one direction, and may be soaked in an adhesive to reinforce the sewn-together portions. After the sewing step is completed, the bag-like fabric layer 2 is turned inside out at the containing opening 6. Thus, there is formed the fabric layer 2 wherein the seam margins *7a* are positioned on the inside surface of the fabric layer.

After a bladder 1 is inserted into the fabric layer 2 through the containing opening 6, the seam margins *7b* are laminated and sewn together to complete a fabric layer 2. The seam margins *7b* are positioned on the outside surface of the fabric layer 2, unlike the other seam margins *7a*.

Figure 4:
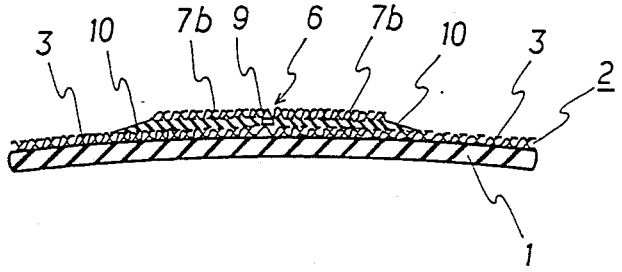
FIG. 4 is a sectional view taken along the line I—I in FIG. 1.

Next, the seam margins *7b* are folded back by 180° and adhered to the surface of the fabric layer by means of mucilage 10 as shown in FIG. 3. Thereafter, compressed air is introduced into the bladder 1 to expand the bladder 1. Thus, as shown in FIG. 4, the fabric layer 2 is extended. Corresponding to the extension of the fabric layer 2, mucilage 10 and seam line margins *7b* are extended to make the surface of the fabric layer flat and gentle, whereby the generation of a mirror-through phenomenon is prevented.

Figure 5:
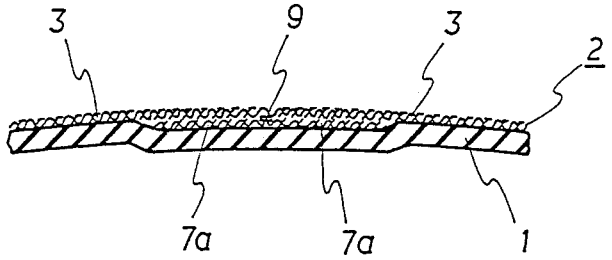
FIG. 5 is a sectional view taken along the line II—II in FIG. 1.

On the other hand, unevenness due to the seam line margins *7a* positioned at the inside of the fabric layer 2 is absorbed by the bladder 1 as shown in FIG. 5, whereby the spherical shape of the fabric layer 2 is maintained.

Figure 6A:
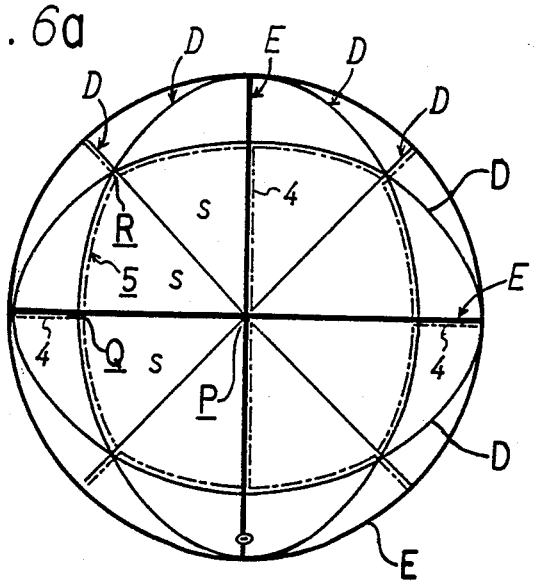
FIGS. 6*a* and 6*b*, are a front view showing positions of circumferential lines in the fabric layer in the first embodiment and showing triangle S.
Figure 6B:
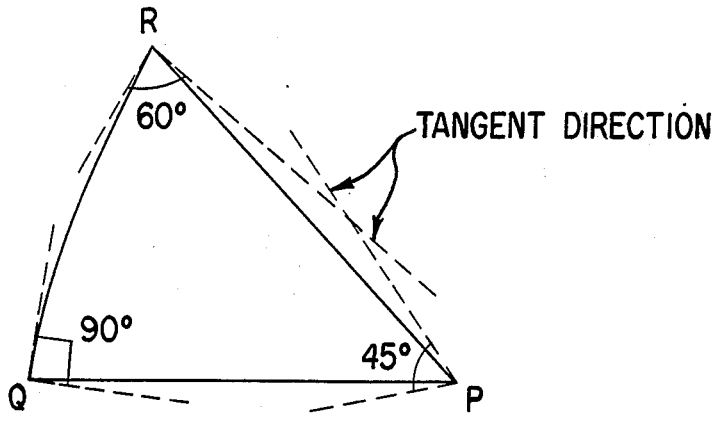

In FIG. 6, there are shown imaginary circumferential lines formed as extended lines of the seam lines. In this figure, alternate long and short dash lines show actual seam lines. The circumferential lines , expressed as continuous fine lines, show the imaginary circumferential lines corresponding to the extended lines of each side of the equilateral quadrilateral piece 5. The circumferential lines , expressed as continuous heavy lines, show circumferential lines corresponding to the extended lines of the central seam lines 4 of the equilateral quadrilateral pieces 5. In this embodiment, there exist six circumferential lines three of which cross one another at each apex of the equilateral quadrilateral pieces 5 at an interval of 60°.

Each two of the circumferential lines cross each other at a center of one central seam line 4 at an interval of 90°. There exist three circumferential lines which fall at right angles with one another. On the imaginary circumferential lines , the ratio of the length of an actually sewn seam line portion of each side of piece 5 to that of the imaginary extended portion, which called an unsewn portion, of the line is 1 to 1.5 (namely about 12 cm to 8 cm in actual dimension). Two seam line portions and two unsewn portions of each line are generated along each of the circumferential lines at a ratio of 1:1.5:1:1.5. On the circumferential lines E, the ratio of the length of an actual central sewn seam line 4 to that of the imaginary extended portion, which is called an unsewn portion, of the line is 1 to 1 (namely about 1 cm to 15 cm in actual dimension). Two seam line portions and two unsewn portions of each line are generated along each of the circumferential lines at an equal interval.

The shape of each of the spherical segments, divided and defined by the above-mentioned nine circumferential lines D and E (six lines and lines), is a spherical triangle having three apex degrees respectively. There exist spherical segments or triangles S on the spherical surface of the fabric layer. Each spherical triangle is defined by outwardly curved lines. The angle at each apex is defined by lines tangential to those curves at the apex (FIG. 6), which form three apex degrees of 60°, 45° and 90°. The angles between the tangent lines at the three apex of the triangle S are 60° (=360°/6, at R), 45° (=360°/8, at P) and 90° (=360°/4, at O).

The ratio of the length of a seam line portion to an unsewn portion is substantially 1 to 1.5, or 1 to 1, and both line portions alternate with each other. Therefore, an influence on the sphericity caused by the structural difference between a seam line portion and an unsewn portion is restrained to the minimum.

The strength of a fabric piece 3 in a direction of warp threads is usually different from that in a direction of weft threads. That is, the strength in the direction of the warp threads is usually larger than that in the direction of the weft threads. Therefore, since the fabric layer 2 is formed by sewing together fabric pieces 3, the elongation of the fabric layer in the direction of the weft threads becomes larger than that in the direction of the warp threads due to the internal pressure applied by the bladder 1. Because of this unequal elongation, a seam line does not completely correspond with a circumferential line including the seam line, and sometimes the seam line curves, with respect to the circumferential line, by several millimeters. Even in that case, because the directions of the warp threads of each fabric piece 3 are regularly arranged with respect to one another in the present invention, the ball does not deform due to the mutual counteraction. Since the deformation of a ball can usually be permitted up to a maximum of about 2 millimeters, the deformation of a fabric piece 3 and an equilateral quadrilateral piece 5 can also be permitted as long as it is within the above range. Even by the mutual counteraction caused by the regular arrangement, the seam lines do not actually completely correspond with the circumferential lines including the seam lines. However, in that case, the seam line might be considered to substantially correspond with the circumferential line and is, therefore, well within the scope of the present invention.

As a suitable material for each fabric piece 3, a plain weave fabric woven of staple fiber spun yarns, can be used. The fabric may comprise mixed yarns of polyester (65%) and cotton (35%) nylon (100%); polyester (100%), and the like. There can be employed a fabric of which numbers of pick (namely, the number of yarns per one inch) are from 30—30 to 150—150. An example of sewing thread includes, for instance, a machine sewing thread comprising aramid fibers, nylon and polyester having a yarn number count of 30 to 40, and a large tensile strength. A machine pitch of 1.5 mm can be used.

In each equilateral quadrilateral piece 5, the directions a of the warp threads of fabric pieces 3 comprising staple fibers are symmetrical with respect to the central seam line 4 and are inclined by 45° to the central seam line 4, as shown in FIGS. 1 and 2. An arrow in FIG. 2 shows the desired direction of the weft threads. The inclination degree is kept within a range of about 20° to about 70°. If the inclination degree is below or above this range, the sphericity of the ball becomes poor. That is, when the inclination degree is 45° the deformation of a ball is limited to not more than 0.5 millimeter. On the other hand, the deformation is about 1 millimeter when the inclination degree is about 20° or about 70° A deformation of about 1 millimeter does not have much influence upon the line of flight of a ball which would give undesirable effects on the play.

Since the fabric piece 3 is woven of spun yarns comprising staple fibers, there are microscopically a large number of naps comprising staple fiber ends on the surface of the yarn. Therefore, when using a plain weave structure, there can be obtained a large weaving strength between the warps and wefts. Accordingly, the strength of the fabric in a bias direction is large and therefore, the deformation of the fabric is considered to be very small if the direction of the central seam lines 4 coincide with the bias direction of the fabric.

Figure 7:
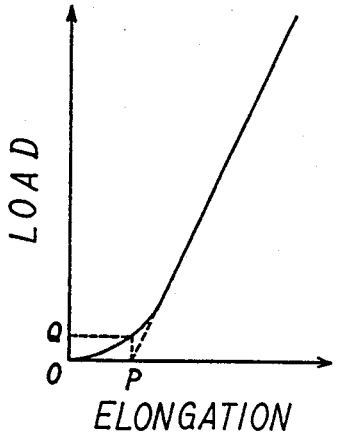
FIG. 7 is a graph showing a load-tension characteristic of the fabric piece in the first embodiment.

The fabric layer 2 is kept at a certain tension because it contains therein the bladder 1 which has been charged with compressed air. The quality of the material, thickness and the like of the yarns are so adjusted that, in the above state of tension, there is obtained a complex state wherein the configurational elongation is approximately at a maximum and the yarns themselves are about to elongate. That is, the fabric layer 2 is in a stable state under elongation P and load Q applied by the bladder 1, as shown in FIG. 7. In FIG. 7, the section between 0 and P shows elongation of yarns. For example, the maximum amount of configurational elongation of a plain weave fabric woven of staple fiber spun yarns comprising mixed yarn of polyester (65%) and cotton (35%) prior to actual elongation of the yarns themselves is about wherein the load in a warp thread direction is 3 kg and that in a weft thread direction is 1.8 kg. The reason why the fabric layer 2 is kept at about a maximum of configuration elongation is as follows. That is, in case that the elongation of the fabric layer 2 is less than the above value, problems can occur in that the pressure in the bladder 1 cannot be kept at a prescribed value and the configuration of the ball cannot be kept at a prescribed size, whereby the feel of the ball becomes poor. On the contrary, when the elongation of the fabric layer is more than the above value, problems can occur in that the feel of the ball becomes poor due to the appearance of feeling hard, and it becomes difficult to maintain the sphericity of the ball due to the influence of sewing accuracy.

Figure 8:
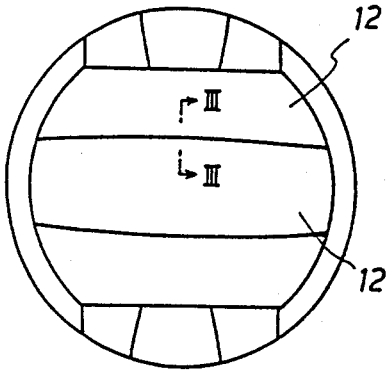
FIG. 8 is a front view showing a completed volley ball in the first embodiment.
Figure 9:
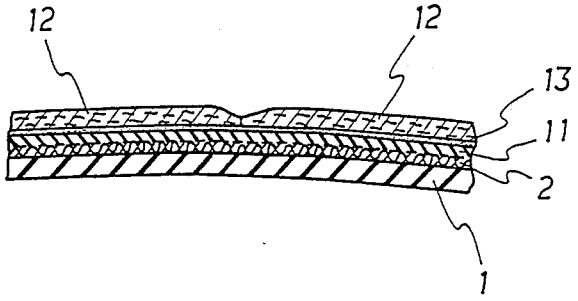
FIG. 9 is a sectional view taken along the line III—III in FIG. 8.

FIGS. 8 and 9 show a finished volley ball having the above-mentioned structure, wherein numeral 11 is a rubber-based thin layer as an intermediate layer covering the fabric layer 2. Numeral 12 is a leather piece having circumferential thin portions. The leather piece 12 is adhered to the thin layer 11 through an adhesive layer 13 such as a mucilage. The leather layer 12 is composed of eighteen natural or synthetic leather pieces of approximately strip-like shape.

In order to make the ball lighter, leather pieces 12 can be directly adhered to the fabric layer 2 using an adhesive without providing a rubber-based thin layer.

Figure 10:
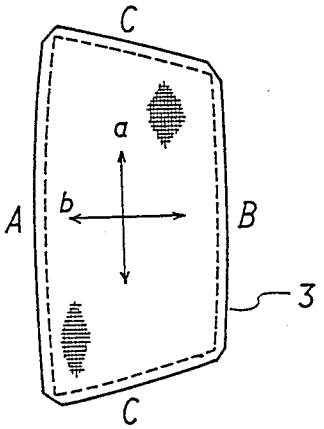
FIG. 10 is a front view of another modification of a fabric piece in the first embodiment.

FIG. 10 shows a modification of a fabric piece 3 of the first embodiment, wherein the direction of the warp threads is parallel to the central seam line 4. Woven fabric comprising continuous filament yarns made of nylon, polyester, and the like is used as the material of the fabric piece 3. The term "continuous filament yarns" means a yarn composed solely of one continuous filament, or a yarn obtained by twisting a plurality of continuous filaments. In the above fabric piece 3, the surface of each of the yarns is smooth, whereby the warps and wefts are easy to slide over each other at the contact surface therebetween. Therefore, although the tensile strength in the directions of the warp threads and weft threads is very large, the tensile strength in a bias direction of the fabric is small. When the woven fabric comprises continuous filaments, the above difference of tensile strength is large compared with a woven fabric comprising staple fibers. Accordingly, the sphericity of high accuracy can be obtained by letting the direction of the warp, along which the fabric has large tensile strength, coincide with a direction of the central seam lines, namely with a longitudinally direction of the fabric piece 3.

As is described hereinbefore, in the present invention, a fabric layer comprises a plurality of fabric pieces which are sewn together to give sphericity, dimensional stability and durability to the ball. Further, on a particular circumferential line in the fabric layer, which includes one seam line, there is provided at least one other seam line at a prescribed interval. Thus, there is provided un-sewed portions between seam lines. Still further, all segments on the spherical surface of the fabric layer, which are divided by a plurality of circumferential lines, including all of the seam sewing lines, have the same shape. Therefore, a particular circumferential line is not solely composed of seam lines, whereby the soft feeling caused by the fabric texture can be obtained even on a particular circumferential line which includes seam lines.

The circumferential lines which include seam lines divide the spherical surface into a large number of segments each having the same shape. That is, the circumferential lines which include seam lines are equally distributed on the spherical surface, whereby the undesirable influence upon sphericity, dimensional stability and durability caused by the seam lines is also equally distributed on the spherical surface. Accordingly, the differences in feel of the ball, depending on the positional difference on a ball surface, are reduced to a minimum, and the generation of a change in shape, over time and the like are also reduced. Thus, the soft feeling inherent in the fabric texture can be obtained.

Next, there is explained a second embodiment of the present invention.

A conventional ball such as a volley ball has a small hole in the fabric layer 2 for the attachment of a valve member. A problem can occur because a portion around the small hole can bulge to cause of a change in the shape of the whole ball with repeated use. This is because the portion immediately around the small hole is weaker than the circumferential portion of the entire ball. In order to solve this problem, there is used in the second embodiment of the present invention a structure explained hereinafter wherein an air inlet valve is provided in the volley ball of the above first embodiment.

Figure 11:
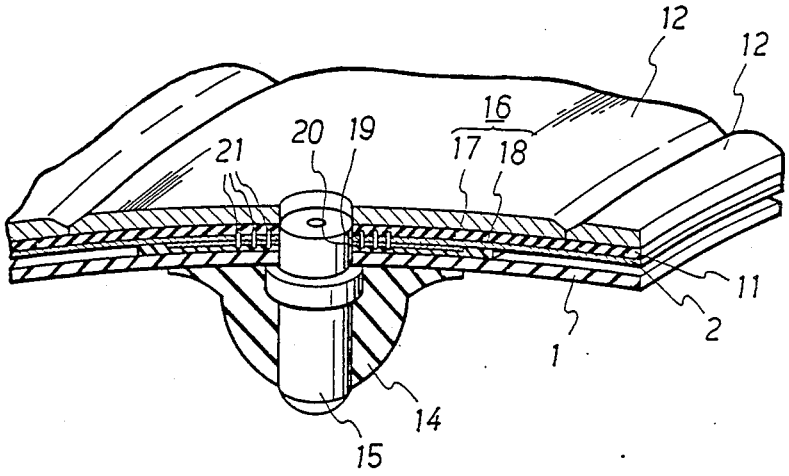
FIG. 11 is a sectional view showing a valve portion in a second embodiment of the present invention.

In FIG. 11, numeral 1 is a bladder into which compressed air is charged. Numeral 14 is a valve holder fixed to the bladder 1. Numeral 15 is a valve member provided in the valve holder 14. The valve member is used for charging air into the bladder 1. Numeral 2 is a fabric layer and numeral 16 is a disk-like patch member of about 2 to 4 cm in diameter comprising a laminate of a fabric patch 17 and a rubber patch 18. The patch member 16 has a small hole 20 coinciding with a small hole 19 made in the fabric layer 2. The valve member penetrates the small hole 19. The patch is interposed between the fabric layer 2 and bladder around the small hole 19, and is connected to the fabric layer 2 by sewing using thread 21. The patch member 16 is adhered to the bladder 1 by an adhesive, for example, mucilage. Numerals 11 and 12 are the rubber-based thin layer and the outer leather piece, respectively.

Figure 12:
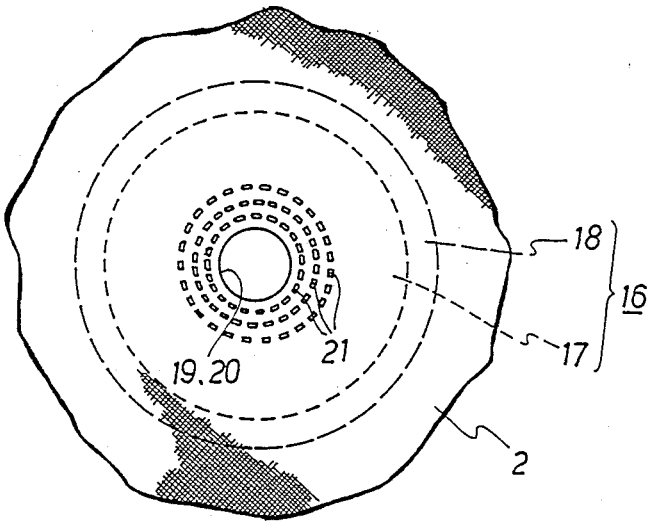
FIG. 12 is a partially front view showing a surface status of a fabric layer around the valve portion in the second embodiment.

FIG. 12 shows a surface of a part of the fabric layer 2 where the valve is attached. Numerals 19 and 20 are the above-mentioned small holes, and numeral 16 is the patch member underneath the fabric layer 2. Numeral 21 is the thread connecting the fabric piece 17 of the patch member 16 and the fabric layer 2. The thread 21 is positioned to surround the small holes 19 and 20.

Figure 13:
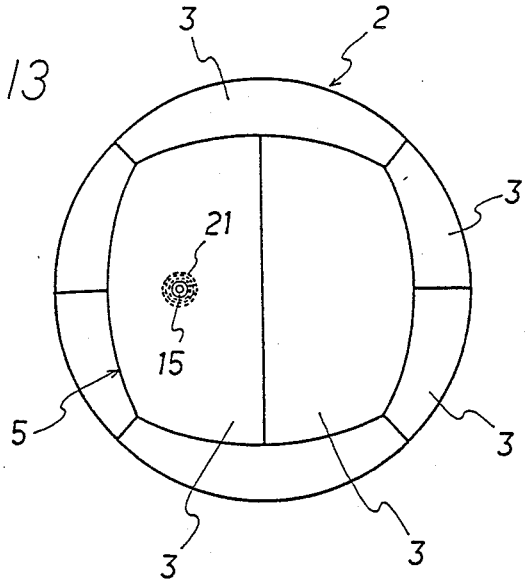
FIG. 13 is a front view showing a status of formed fabric layer in the second embodiment.

FIG. 13 shows a half-finished ball comprising a fabric layer. A small hole 19 (not shown in FIG. 13) is made in the approximate center of one of the fabric pieces 3. The patch member 16 is put on the fabric piece 3 in such a manner that the small holes 19 in fabric layer 2 will coincide with the hole 20 in patch member 16. The patch member 16 is sewed on the fabric layer 2. Thereafter, the fabric layer 2 is turned inside out through the containing opening. Next, an airless bladder 1 is put inside the fabric layer 2 through the containing opening. Then, the containing opening 6 is sewed up. A valve holder 14 on the bladder 1 is located at the small hole 19 in the fabric layer 2. By expanding the bladder 1, the adhesion of the fabric layer 2 to the bladder 1 by an adhesive applied beforehand on the patch member 16 can be obtained.

Figure 14:
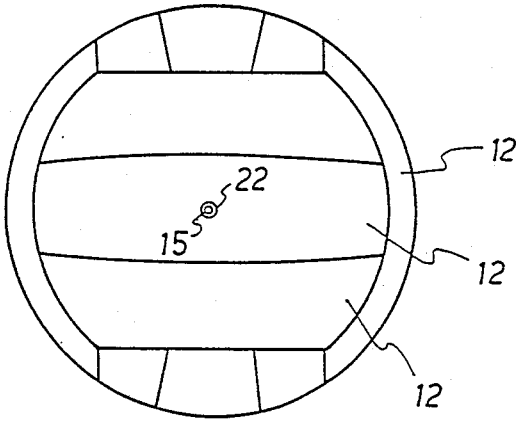
FIG. 14 is a front view showing a finished ball in the second embodiment.

FIG. 14 shows a finished volley ball having the above mentioned structure, wherein numeral 12 is one of the eighteen natural or synthetic leather pieces forming the outer covering of the ball. Numeral 22 is a small hole formed on one leather piece 12 allowing the valve member 15 to penetrate.

Figure 15:
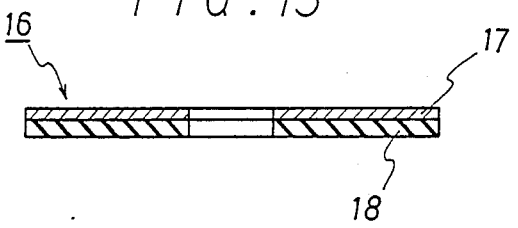
FIG. 15 is a sectional view showing another modification of a patch member in the second embodiment.
Figure 16:
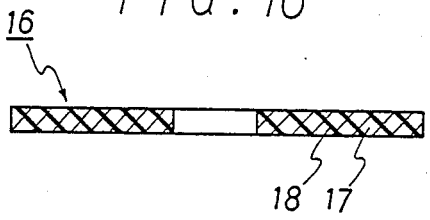
FIG. 16 is a sectional vie still another modification of the patch member in the second embodiment.

FIG. 15 shows another embodiment of a patch member 16 wherein a rubber patch 18 is integrally connected to one side of a fabric patch 17. FIG. 16 shows still another embodiment of a patch member 16 wherein the fabric patch is impregnated with rubber. In case of using these patch members 16, the rubber patch is also sewn to the fabric layer 2 using the thread 21 along with the fabric patch. The shape of the patch member 16 is not particularly limited to a circle. It might be other shapes such as a square. According to these structures described above, the fabric layer 2 is reinforced by the patch member 16 around the small hole 20 for the valve member and is further reinforced by threads 21 surrounding the small holes 20 and 19. Therefore, the threads of the fabric layer 2 around the small hole 20 are not in danger of fraying, and any frayed portion is not in danger of spreading. In this manner, the conventional problem wherein the ball expands and distorts around the area of a valve member portion is eliminated.

Next, there is explained a third embodiment of the present invention.

A sewn-together fabric layer has the function of not only feeling soft as described above, but also having dimensional stability, sphericity and durability for the ball. However, even in this case, there is a potential problem of a rip generated in a seam portion of the fabric, since the seam portion is particularly poor in durability. In practice, in a sewn structure as disclosed in U.S. Pat. No. 2,091,455, namely in a sewn structure wherein a seam portion is projected toward the bladder, the maximum value of a compression test (a test where a ball is repeatedly compressed by 33% in a direction of a diameter thereof) is about . compressions cycles. The above problem can be minimally solved by folding back the seam margins of the fabric pieces, constituting the fabric layer, by 180° towards the bladder 1. Although the strength of the seam portion is improved according to the above structure, new problems are created because the manufacturing process becomes complicated. That is, folding back the seam margin by 180° is required, and the folded-back condition is required to be maintained using an adhesive, or the like.

In the present invention, the above problem can be solved by means of a third embodiment having a structure explained hereinafter.

Figure 17:
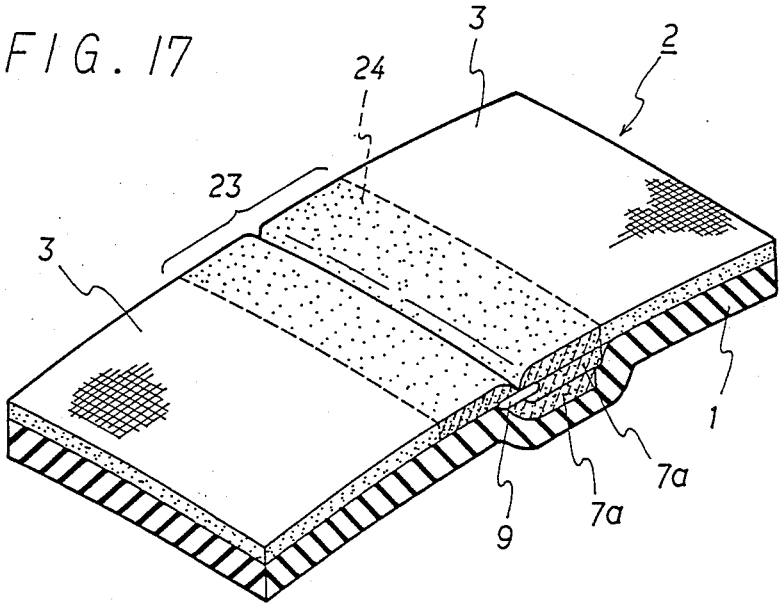
FIG. 17 is a perspective view of a principal portion of a third embodiment of the present invention.

FIG. 17 shows a seam portion in the third embodiment. As shown in FIG. 17, when an airless bladder 1 is put into a sphere bag-like fabric layer 2 formed by sewing together fabric pieces 3. The containing opening is closed, and then compressed air is introduced into the bladder to expand it. The bladder elastically contacts with an inner surface of the fabric layer 2 to give an internal pressure of the bladder 1. Seam margins *7a* are usually folded back in the same direction. But, the seam margins are sometimes folded back irregularly at the middle portion of the seam. For instance, the middle portion is sometimes folded back in an direction opposite to that of both of the end portions, or the seam margins at a middle portion are folded back in opposite directions to each other. In FIG. 17, the seam margins are folded back to the right side of the FIG.. The folded back condition cannot be predetermined, but is determined by the application of internal pressure of the bladder 1. Because a seam portion 23 is applied or impregnated with a reinforcing agent, for example, an adhesive, the seam portion 23 has high strength, so that a rip can not spread from the portion 23.

In FIG. 17, numeral 24 is a reinforcing agent which permeates the seam portion 23. The reinforcing agent 24 fills gaps between warps and wefts in the seam portion to firmly connect them. It further fills holes (not shown) around the machine threads 9 to prevent these holes from spreading. One material for the reinforcing agent can be an adhesive such as urethane adhesives, for example, CRISVON (Registered Trademark) made by Dainippon Ink & Chemicals, Inc. or TAKELAC A-353 (Registered Trademark) (main agent) and TAKENATE A-3 (Registered Trademark) (hardening agent) made by Takeda Chemical Industries, Ltd.; nylon adhesives, for example, LUCKAMIDE 5003 (Registered Trademark) made by Dainippon Ink & Chemicals, Inc.

Two fabric pieces 3 are sewed together at a seam line 8 (shown in FIG. 2) by a thread 9 using a sewing machine after the fabric pieces 3 are laminated. In this operation, a reinforcing agent 24 such as an adhesive is successively supplied to the seam portion 23 from a nozzle (not shown) disposed ahead of or to the rear of the sewing needle. In result, the reinforcing agent 24 permeates the fabric layer by a width of 5 mm centered around the seam line . The width of permeated portion can be varied within a range from about 3 mm to about 10 mm. The portion where the reinforcing agent 24 is supplied may be shifted to the side of the seam margins *7a*. The reinforcement of seam margins *7a* prevent the threads of the fabric pieces from fraying even when the extensile force due to thread 9 is applied to the seam margins *7a* to press the threads of the fabric pieces. The durability of a ball having a fabric layer 2 reinforced in accordance with the above process was measured using a compression test machine. In result, no rips were generated in the ball, even after 50,000 compression cycles were carried out.

Figure 18:
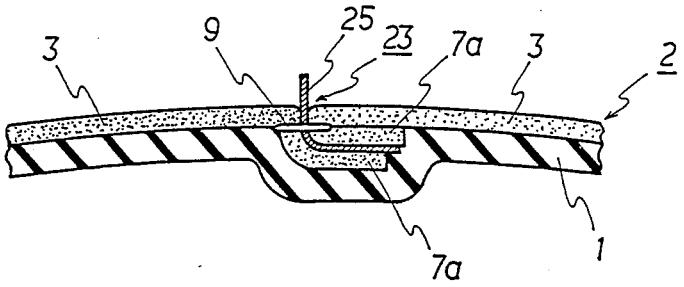
FIG. 18 is a sectional view showing reinforcing structure in the third embodiment wherein a sheet-like adhesive is used.
Figure 19:
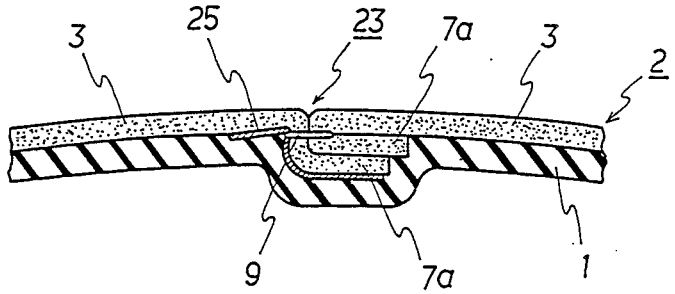
FIG. 19 is a sectional view showing another modification of the reinforcing structure in the third embodiment wherein a sheet-like adhesive is used as in FIG. 18.

FIGS. 18 and 19 show modifications of the third embodiment wherein a tape-like or sheet-like hot melt type adhesive is used as a reinforcing agent. The modification in FIG. 18 has the structure wherein an adhesive sheet 25 about mm wide is sandwiched between two laminated fabric pieces 3 at their seam portion 23. The adhesive sheet 25 and the two fabric pieces 3 are sewed together by threads 9. The modification in FIG. 19 has a structure wherein two fabric pieces 3 are laminated. An adhesive sheet 25 is further laminated to one outer side of one of the laminated fabric pieces and then they are sewed together by threads 9. With the modification shown in FIG. 19, the adhesive sheet 25 is positioned on the side of the seam margins *7a* having a smaller folding degree, because a seam portion 23 having a smaller folding degree is mechanically weak. The folding direction of these two sheets of seam margins 7 is determined by turning down the seam margins *7a* in the above-mentioned direction and sewing them, when sewing an equilateral quadrilateral piece 5 with an adjoining equilateral quadrilateral piece 5. Thus, both ends of the seam margin 7 are turned down in one direction. Therefore, the middle portion of the seam margins *7a* are turned down almost in the same direction in accordance with both of the end portions. However, the middle portion, particularly, the central portion is possibly folded back in the direction opposite to that of the end portions as described above. Accordingly, the structure shown in FIG. 18 is more preferable than that in FIG. 19, if a more permanent seam throughout the seam margins *7a* is required.

An adhesive sheet 25 described hereinbefore that can be used is polyamide adhesives, for example, SOFSET (Registered Trademark) made by Japan Vilene Company, Ltd.; polyester adhesives, for example KEMIT (Registered Trademark) made by Toray Industries, Inc. or the like.

The above adhesive sheet 25 melts when heated and permeates the seam portion 23 of a fabric layer 2, when the rubber-based intermediate thin layer 11 is cured after setting a ball in a mold, or when the leather pieces 12 are adhered to the surface of the ball in a mold. By using the above method, the same structure with reinforced seam portions can be obtained as when liquid adhesives are used.

Figure 20:
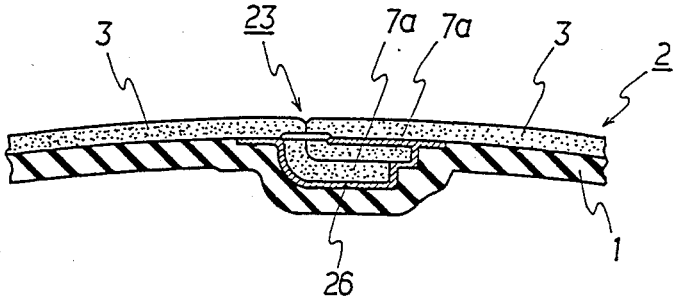
FIG. 20 is a sectional view showing a reinforcing structure in the third embodiment wherein a mucilage is used.

FIG. 20 shows another modification of the third embodiment wherein a mucilage 26 is employed as a reinforcing adhesive. The mucilage 26 is applied on the seam portion 23 which faces the bladder 1. The mucilage 26 does not permeate the fabric layer 2, but forms a thin layer on the fabric layer surface. Since the mucilage 26 has elasticity even after drying and adhesion are completed, no problem occurs when the seam portion 23 hardens. Thus, using mucilage 26 is preferable in this kind of a ball. As a result of testing, by means of a 33% compression test machine, a ball having a fabric layer 2 reinforced by applying natural rubber mucilage has a confirmed superior durability, i.e. the ball withstood about 200,000 cycles of a compression test.

According to the structure of the third embodiment, the durability of the entire fabric layer 2 can be improved, because the reinforcing agent 24 (shown in FIG. 17) permeates the seam portions of the fabric layer 2, functioning as a reinforcing layer to improve the strength of the seam portions 23. Further, in the structure of the third embodiment, the manufacturing of the fabric layer 2 can be simplified because the seam margins *7a* which are folded toward the bladder 1 can be left as they are (namely it is not necessary to spread the seam margins by 180°) due to the reinforcement of the sea portions 23 by a reinforcing agent 25.

Next, the "feel" of a ball of the present invention having the structure as described hereinbefore will be explained. The feeling that occurs when a ball, such as volley ball or soccer ball, collides with the human body is a mental process involving stimulation. The stimulation is two-sided and includes quantity and quality. In daily life, if the quantity of stimulation is equivalent, the sense obtained differs depending on the difference of the quality of stimulation. Based upon this quality of stimulation, a method for evaluating the feel of a ball based on a frequency region has been proposed by frequency analyzing the impact waveform using a mathematical technique of Fourier transformation. The evaluation obtained by this method is confirmed to coincide with an evaluation by the conventional method which rely on the senses of an expert.

In general, a perceptive system of a person is considered to be a differential-type system. That is, the person is insensitive to steady stimulation, while sensitive to unsteady stimulation. For example, when a light object is placed on a hand, the weight of the object is felt immediately thereafter, but this feeling decreases with the passage of time. This phenomenon is well known, not only in the tactual sense, but also occurs with the senses of sight, smell, and the like. Thus, the change of stimulation over time is important to the senses of a person, and therefore when examining the feel of a ball, an analysis of the components of the stimulation is important and not an analysis of quantity of stimulation.

Steep impact waveforms have a large number of steps per unit of time, i.e. minimum tactual sense steps to which a person is sensitive (Fechner's sensible difference), while gentle impact waveforms have few steps. That is, the number of tactual sense steps per unit of time has a relationship with the feel of balls. The number of tactual sense steps per unit of time corresponds to a frequency. In the present specification, such a frequency is referred to as a "sensitive frequency". By Fourier-transforming the impact waveforms, a determination can be made as to what and how much sensitive frequency is included in the impact waveforms. A Fourier-transformed impact waveform is called a power spectrum M. The feel of a ball, that is, impact feel can be evaluated based upon the value of the power spectrum M.

The mathematical process of Fourier transformation can be shown as follows. Fourier transformation F ($\omega$) (wherein $\omega$ is the sensitive frequency) can be found according to the following formula:

$$F(\omega) = \int_{\infty}^{\infty} F(t)e^{-j\omega t}dt \quad (1)$$

Figure 21:
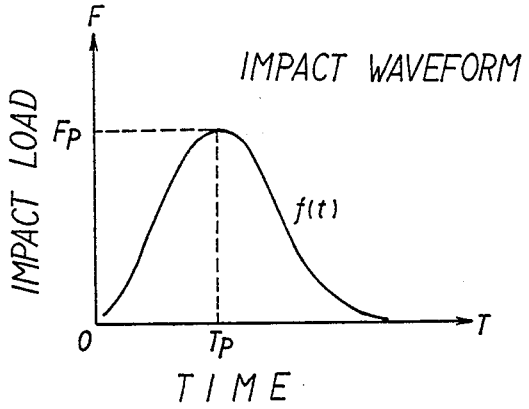
FIG. 21 is a graph showing an impact waveform of a ball.

(wherein F (t) is an impact waveform shown in FIG. 21).

In the formula (1), F($\omega$) is generally a complex number and is represented by the following formula:

$$F(\omega)=A(\omega)\, e^{j\phi(\omega)} \quad (2)$$

wherein A($\omega$) and $\phi(\omega)$are amplitude and phase, respectively.

Power spectrum M(u) is represented by the following formula using a complex conjugate F*($\omega$), assuming that the impact feel by balls does not depend on the phase term:

$$M(\omega) = F(\omega) \cdot F^*(\omega) = A^2(\omega). \quad (3)$$

F($\omega$) and A($\omega$) can be found in practice by using a computer. An algorithm for FFT (Fast Fourier Transform) used for this process has been developed.

Figure 22:
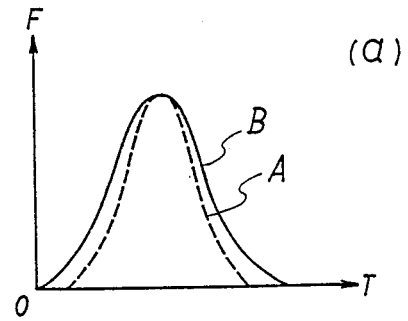
FIG. 22(*a*) is a graph showing two different impact waveforms.
Figure 22:
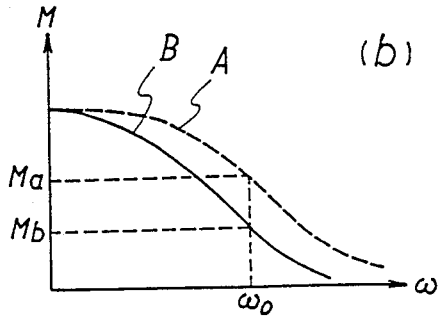

The power spectrum M can be found by the above steps. The waveform of the power spectrum M has various kinds of shapes depending on the original waveform. Power spectrums M corresponding to impact waveforms A and B in FIG. 22(*a*) are shown in FIG. 22(*b*). The difference in the shapes of the curved lines is due to the difference in the regions that they are based upon. In the time region (in FIG. 22(*a*)), the difference of signals A and B is expressed by the slope, while in a frequency region (in FIG. 22(*b*)) the difference of a degree of the slope is shown by a vertical line. In FIG. 22(*b*), power spectrum Ma or Mb included in a certain sensitive frequency $\omega$ is a total of $\omega$ included in the original waveform. Therefore, it is possible to clearly compare the difference in the feel of the ball. In FIGS. 22(*a*) and 22(*a*), the relationship between waveforms A and B with respect to size thereof is reversed. The reason is the power spectrum of waveform A at each $\omega$ becomes larger than that of waveform B, because waveform A is steeper than waveform B. In general, a small difference in the waveforms in a time region is enlarged in a power spectrum region. Therefore a subtle difference in a graph based on the time region such as in FIG. 22(*a*) can be clearly understood in a graph based on the frequency region such as in FIG. 22(*b*). Impact waveforms of various kinds of balls are almost the same in practice, but they are clearly distinguished from one another if the Fourier transformed power spectrum is used.

By letting the characteristics of the human perceptive system correspond to the character of the Fourier transformation, the following can be concluded. The impact of a ball which a person perceives as soft, has a small power spectrum in the high frequency region. That is, the impact has few sensitive steps per unit of time. Referring to FIGS. 22(*a*) and 22(*b*), it can be concluded that the waveform B represents a softer feeling than the waveform A. This conclusion coincides with an evaluation by an expert. With respect to the impact of a ball, a "denting feeling" is due to the rapid reduction of the power spectrum M. It is easy to distinguish this "denting feeling" from a "soft feeling". On the other hand, an impact which feels hard is characterized by a spectrum distribution which is widely extended, namely the impact has a large number of steps. It is therefore, also easy to distinguish the impact having a hard feeling from one that has a soft feeling.

Figure 23:
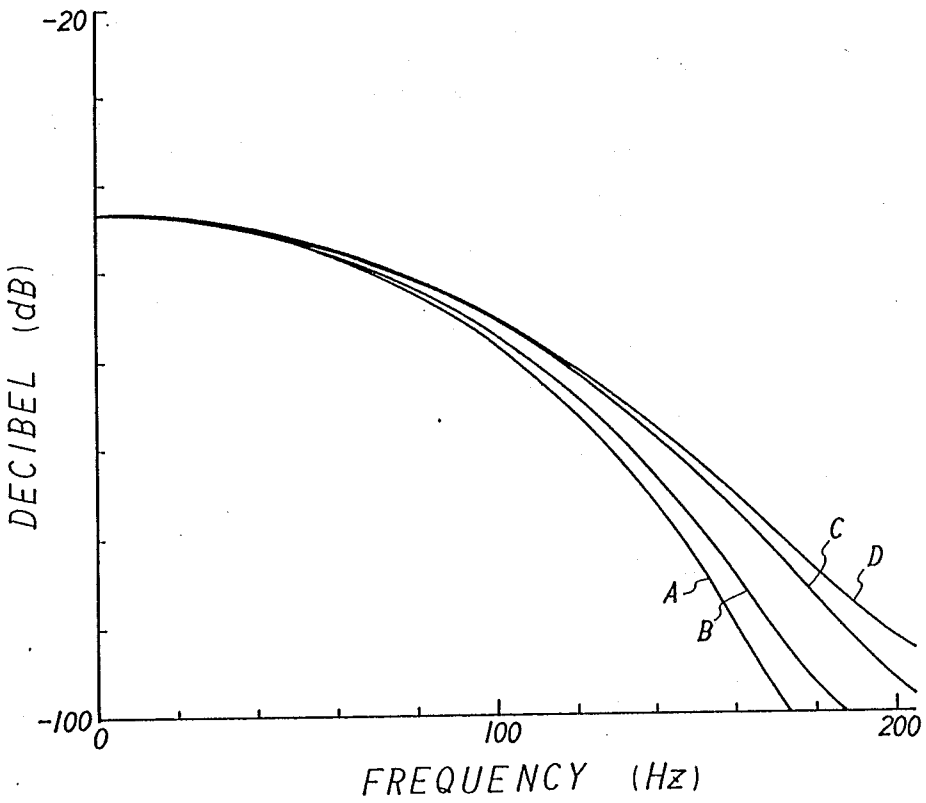
FIG. 23 is a graph showing a decibel versus frequency characteristics analyzing waveforms of various kinds of balls having different structures one from another by means of FFT.

FIG. 23 shows waveforms obtained by analyzing impact waveforms of balls having various kinds of structures using FFT, wherein the axis of the ordinate represents values of the power spectrum transformed into decibels (dB) and the axis of the abscissa represents frequency. In FIG. 23, curved lines A to D show waveforms of balls having structures described hereinafter.

A: The ball has a structure according to the embodiment of the present invention wherein a plain weave fabric is woven of staple fiber spun yarns comprising mixed yarns of polyester (65%) and cotton (35%) which is used as the material of the fabric layer.

B: The ball has a structure having a reinforcing layer formed by impregnating cotton fabrics with paste and applying two layers of the impregnated cotton fabrics on a bladder. This structure is similar to those disclosed in U.S. Pat. No. 4,239,568 and Japanese Examined Patent Publication No. 8519/1965, which are prior art.

C: The ball has a structure having a reinforcing layer formed by winding several thousands of meters of nylon yarns around a bladder. This structure is similar to that disclosed in U.S. Pat. No. 4,333,648, which is prior art.

D: The ball has a structure having a reinforcing layer formed by winding several thousands of meters of nylon yarns and cotton yarns around a bladder.

In FIG. 23, the curved line A shows the lowest dB number while the curved line D shows the highest dB number in the high frequency region, namely in the region from about 120 Hz to about 200 Hz. According to FIG. 23, a ball with the curved line D gives the worst feeling. In practice, a ball according to curve D gives a hard feeling because cotton yarns which are inferior in elongation extendibility are used. The order from A to D showing feel of the ball illustrated in FIG. 23 coincides with the order of increasing hardness determined by experts.

Next, the sphericity of a ball will be explained. The following Table 1 shows results of a compression test (where five hundred 33% compression cycles were carried out) with respect to volley balls , and C having the above-mentioned structures and having the waveforms shown in FIG. 23. In the following Table 1, "sphericity" means a difference between a maximum radius and a minimum radius.

TABLE 1

| | | | Radius (mm) | Sphericity (mm) |
|---|---|---|---|---|
| Ball | A | new ball | 99.0 | 0.83 |
| | | after test | 99.2 | 1.23 |
| | B | new ball | 99.2 | 1.07 |
| | | after test | 99.7 | 2.37 |
| | C | new ball | 99.3 | 0.83 |
| | | after test | 99.5 | 0.88 |

Figure 24:
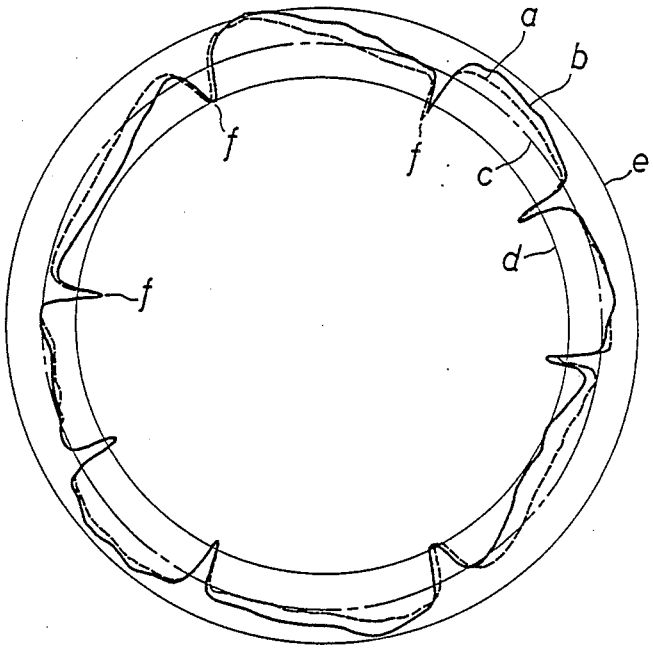
FIGS. 24 to 26 are views showing exaggerated outward forms of balls before and after a compression test.
Figure 25:
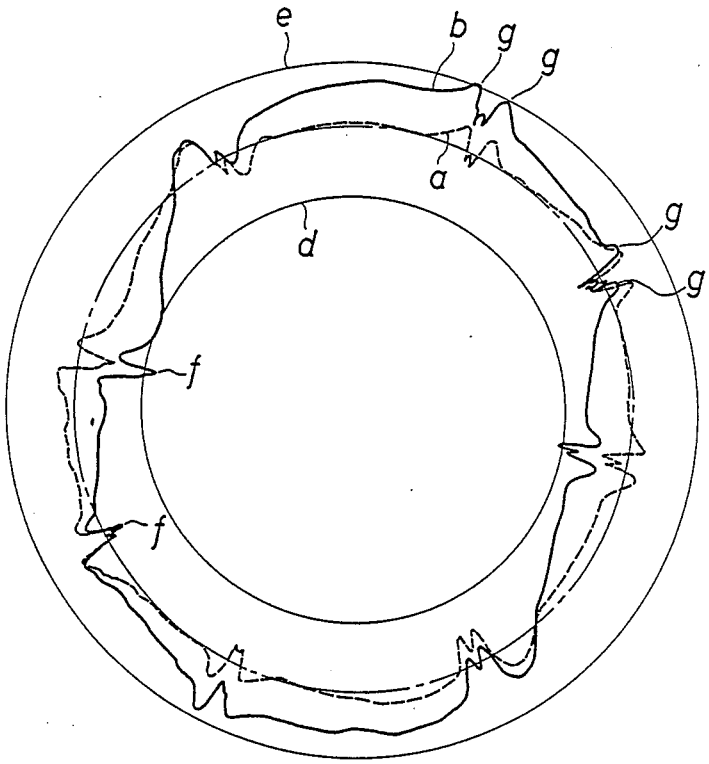
Figure 26:
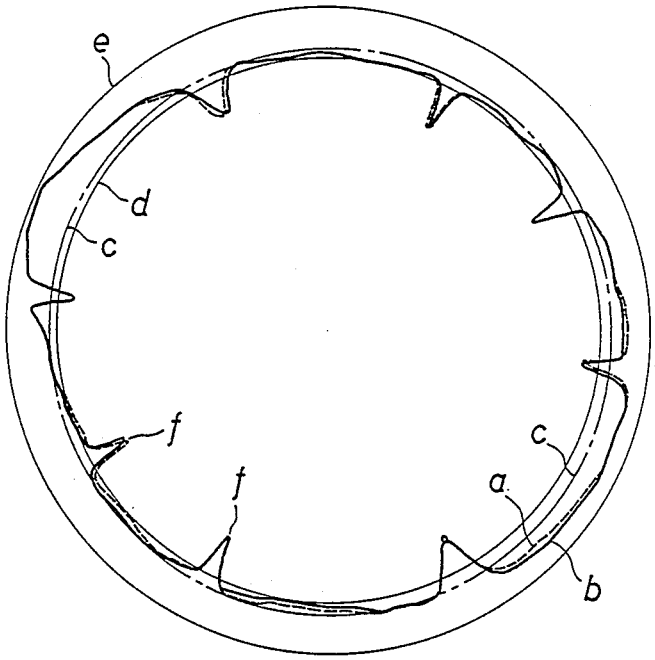

FIGS. 24 to 26 are views showing exaggerated outward forms of the above balls A, B, and C, respectively, where short dashed lines mean outward forms of new balls, and continuous lines mean the form of those balls after compression testing. A circle c shows a standard circle, and circles d and e show respectively an inscribed circle and a circumscribed circle with respect to the curved line showing the deformation of the ball. In FIGS. 24 to 26, a steep ditch portion is a ditch formed at a joint between leather pieces. Thus, the portion f should be ignored in relation to the determination of sphericity.

In a ball A according to an embodiment of the present invention shown in FIG. 24, the deformation is not one-sided and the width of the deformation is relatively small. From the relationship among inscribed circle , circumscribed circle e and standard circle c, the outward and inward formation of the ball are the same value, and the size of the ball is, on the average, kept to a size represented by the standard circle c.

In FIG. 25, the deformation of a ball B after compression testing is so large as to reach 2.37 mm. This deformation is mainly caused by the weakness of overlapped portions of abutting fabric pieces in comparison with a portion surrounding the overlapped portions. The reinforcing effect by the leather pieces cannot be obtained at an overlapped portion because the joints of the leather pieces are positioned on the overlapped portion in order not to make the mirror through phenomenon prominent. The above deformation is a problem essential to a ball having the above structure. The ball having such a sphericity as shown in Table 1 and FIG. 25 cannot fly straight, that is, lateral movement is generated during the flight of the ball. Thus, these balls are not suitable in a high-level game where high skilled technique is used. FIG. 25, shows a projection g adjoining the ditch portion f. This projection g is caused by the overlapped portion of the fabric pieces. The projection g comes out as a mirror through problem, and causes a poor feeling when the ball collides with the hands of a player. This mirror through problem is likely to be clearly visible, that is, the joints of the fabric pieces can be observed on the ball surface, with the repeated use of the ball. Therefore, such structure is not desirable as consumer goods.

A ball C shown in FIG. 26 has the smallest deformation, and has the best result with respect to sphericity.

What we claim is:

1. A ball for a ball game comprising:

a rubber hollow spherical bladder;

a valve holder fixed to the bladder for charging air into the bladder;

a valve member attached to the valve holder;

a fabric layer covering a surface of the bladder composed of a plurality of equilateral quadrilateral pieces sewn together to form a sphere, the fabric layer giving sphericity, dimensional stability and durability to the ball, said equilateral quadrilateral pieces each comprising two sheets of approximately trapezoidal fabric pieces that are sewed together symmetrically at a central seam line, said equilateral quadrilateral pieces being sewed together such that said central seam lines of adjacent equilateral quadrilateral pieces fall at right angles to each other; and a leather layer adhered to the fabric layer.

2. The ball of claim 14, wherein six equilateral quadrilateral pieces the sphere, each trapezoidal fabric piece defined by two approximately parallel long sides A and B, wherein A and B satisfy the relationship of $A>B$, which are curved outwardly and two short sides C having equal length wherein B and C satisfy the relationship of $B=2C$.

3. The ball of claim 2, wherein each fabric piece comprises a woven fabric composed of staple fibers, wherein warp lines of each fabric piece are about the central seam line and inclined by about 20° to 70° with respect to the central seam line.

4. The ball of claim 2, wherein each fabric piece comprises a woven fabric composed of continuous filament, wherein warp lines of each fabric piece are approximately parallel to long sides of the fabric layer.

5. The ball of claim 2, wherein the fabric layer has a containing opening which comprises an un-sewed portion closed by the sewing after the bladder is inserted in the fabric layer, each seam margin of the containing opening being solely positioned at an outside of the fabric layer and folded back by 180°, and other seam margins of the fabric layer are positioned at a side of the fabric layer next to the bladder.

6. The ball of claim 5, wherein the containing opening is formed at the central seam line of one of the equilateral quadrilateral pieces.

7. The ball of claim 5, wherein the seam margins of the containing opening are adhered by mucilage to a surface of the facing fabric layer, and, when the fabric layer is stretched by internal pressure of the bladder, a tensile force applied to the fabric layer is transmitted to the seam margins of the containing opening through the mucilage.

8. The ball of claim 1, wherein the fabric layer has a small hole through which a valve member penetrates; a patch member comprising fabric and rubber for reinforcing a portion of the fabric layer around the small hole, the patch member being interposed between the fabric layer and the bladder in a region including the small hole; and as thread member for fixing the path member to the fabric layer around the small hole; the fabric layer being adhered and fixed to the bladder through the patch member.

9. The ball of claim 1, wherein a seam margin of each fabric piece is positioned on a side of the fabric layer next to the bladder, and a seam portion is coated or permeated with a reinforcing agent.

10. The ball of claim 9, wherein the reinforcing agent is an adhesive.

* * * * *